US011992748B2

(12) United States Patent
Cyr

(10) Patent No.: US 11,992,748 B2
(45) Date of Patent: May 28, 2024

(54) TELEMARK FREE HEEL TOURING-STYLE SKI BINDING

(71) Applicant: Wedjat, LLC, Driggs, ID (US)

(72) Inventor: William L. Cyr, Driggs, ID (US)

(73) Assignee: Wedjat, LLC, Driggs, ID (US)

( * ) Notice: Subject to any disclaimer, the term of this patent is extended or adjusted under 35 U.S.C. 154(b) by 25 days.

(21) Appl. No.: 17/367,234

(22) Filed: Jul. 2, 2021

(65) Prior Publication Data

US 2021/0331062 A1 Oct. 28, 2021

Related U.S. Application Data

(62) Division of application No. 16/137,528, filed on Sep. 20, 2018, now Pat. No. 11,097,181, which is a division of application No. 13/841,302, filed on Mar. 15, 2013, now Pat. No. 10,105,587.

(60) Provisional application No. 61/623,551, filed on Apr. 12, 2012.

(51) Int. Cl.
*A63C 9/02* (2012.01)
*A63C 9/06* (2012.01)

(52) U.S. Cl.
CPC ..... *A63C 9/02* (2013.01); *A63C 9/065* (2013.01)

(58) Field of Classification Search
CPC .. A63C 9/02; A63C 9/245; A63C 9/24; A63C 9/12; A63C 9/06; A63C 9/065
See application file for complete search history.

(56) References Cited

U.S. PATENT DOCUMENTS 2,176,226 A * 10/1939 Reed, Jr. ..... A63C 9/06 280/622
3,012,793 A * 12/1961 Beyl ..... A63C 9/083 280/621
3,489,122 A * 1/1970 Gottfried ..... A63C 9/0846 280/634
3,881,738 A * 5/1975 Salomon ..... A63C 9/08578 280/634
3,943,882 A * 3/1976 Sollak ..... A63C 9/0805 280/634
5,333,892 A * 8/1994 Stritzl ..... A63C 9/0805 280/634
5,499,838 A * 3/1996 Hauglin ..... A63C 9/12 280/622
5,823,563 A * 10/1998 Dubuque ..... A63C 9/086 36/62
6,234,514 B1 * 5/2001 Dubuque ..... A63C 9/083 280/619
7,219,917 B2 * 5/2007 Walker ..... A63C 9/245 280/634

(Continued)

*Primary Examiner* — Frank B Vanaman
(74) *Attorney, Agent, or Firm* — Vela Wood; Steven Wood

(57) ABSTRACT

A spring or alternative elastic, resilient, compressible media cassette for a touring-style ski binding, such as used in alpine touring or telemark skiing. The touring ski binding slip differential cassette provides the skier with variety of tuning options to manually adjust binding size, stiffness, and range of motion. Manual adjustment of binding size, stiffness, and range of motion enhances the touring ski binding ease of use, adjustability, and overall capabilities, further progressing the touring ski binding. In addition, the slip differential cassette provides the touring skier with cassette presets that match each skier to a predetermined binding size, stiffness, and range of motion based on skier weight and ability.

19 Claims, 12 Drawing Sheets

(56) References Cited

U.S. PATENT DOCUMENTS

| | | | | |
|---|---|---|---|---|
| 7,246,812 | B1 * | 7/2007 | Ayliffe | A63C 9/20<br>280/619 |
| 2009/0295126 | A1 * | 12/2009 | Wollo | A63C 9/02<br>280/615 |

* cited by examiner

TELEMARK FREE HEEL TOURING-STYLE SKI BINDING

CROSS REFERENCE TO RELATED U.S. PATENT APPLICATIONS

This application is a divisional of and claims the benefit under 35 U.S.C. § 121 of the earlier filing date of U.S. Nonprovisional application Ser. No. 16/137,528, filed on Sep. 20, 2018, which itself is a divisional of and claims benefit under 35 U.S.C. § 121 of the earlier filing date of U.S. Nonprovisional application Ser. No. 13/841,302, filed on Mar. 15, 2013, which itself claims the benefit under 35 U.S.C. § 119(e) of the earlier filing date of U.S. Provisional Application Ser. No. 61/623,551, filed on Apr. 12, 2012, all of which are hereby incorporated in entirety by reference.

FIELD OF THE INVENTION

The present invention relates to the field of "free heel" styles of skiing, including, but not limited to, alpine touring, ski touring, telemark skiing, backcountry skiing, and Nordic or cross-country skiing. In particular, the present invention relates to an improved binding mechanism for enhancing the dynamics and control of the "free heel" motion.

BACKGROUND OF THE RELATED ART

For the purposes of this patent application, "touring-style" means skiing styles, including, but not limited to, alpine touring, ski touring, telemark skiing, backcountry skiing, and Nordic or cross-country skiing, and "touring-style" binding means ski binding equipment for use with ski gear appropriate to any one of these skiing styles.

Touring-style skiing requires touring-style binding equipment, which permits a "free heel" motion. In touring-style skiing the heel-portion of the ski boot is releasably attached to a touring-style binding, which provides an elastic or semi-elastic connection to the ski, a ski plate, or to a binding toe-piece. The binding toe-piece is fixedly attached to the ski or to a ski plate, which is attached to the ski, and releasably attaches to the toe of the ski boot, allowing the heel of the ski boot to move freely within a specific range of motion.

In touring-style skiing, the binding connects the toe of the ski boot to the ski, directly or indirectly. When connected indirectly, the toe of the ski boot may be attached via the binding toe-piece to a ski plate, which is attached to the ski. In motion, the skier's heel describes an arcuate trajectory, between a resting point, atop the ski or on top of a binding heel-piece, and a fully extended position. The skier's heel moves primarily in the plane intersecting the longitudinal axes of the skis and substantially perpendicular to the plane of the top surface of the ski.

Appropriate motion of the skier's heel depends on tolerances of the ski, boot, binding, and the skier's foot and leg and includes a rotating or pivoting action about an axis defined by the intersection of the boot toe and the binding toe-piece. Thus, the skier's boot can pivot at the attachment between the binding toe-piece and the toe of the ski boot to provide the skier's heel with free mobility and thereby enable a striding motion. This allows the skier to stride on flat terrain, to initiate and terminate turns, and to ascend steeply inclined slopes, in combination with climbing skins or crampons, without resorting to side stepping or herring-boning.

Conventional cartridge bindings for touring-style skiing offer a single, limited method of adjustment for controlling binding responsiveness, namely, manually changing out binding cartridges of different stiffness ratings. This method requires the skier to acquire and carry multiple cartridges of differing elastic/compressive stiffness categories. When the skier wants to change binding cartridge stiffness to adjust responsiveness and range of motion of the binding mechanism, the skier must manually disconnect the current cartridge and manually connect a new cartridge.

Touring-style skiers demand equipment that is light, reliable, and capable of accommodating changing terrain, weather conditions, and individual preference. It is apparent that the current cartridge binding systems have specific adjustment and control disadvantages. Further development of touring-style ski binding capabilities to provide for easier, dynamic adjustment and control is hereby acknowledged as necessary to advance the current art.

The need for a touring-style ski binding cartridge replacement with the ability to manually and dynamically control binding size, stiffness, and range of motion is accordingly recognized. The present slip differential cassette meets these needs, providing superior binding adaptability and permitting the skier to dynamically adjust and control the response of the binding on the fly to accommodate changing conditions and individual preference.

SUMMARY OF THE INVENTION

The following is a summary of the invention in order to provide a basic understanding of some aspects of the invention. This summary is not intended to identify all key or critical elements of the invention or to delineate the entire scope of the invention. Its sole purpose is to present some concepts of the invention in a simplified form as a prelude to the more detailed description that is presented later.

Reference throughout this specification to "one embodiment" or "an embodiment" means that a particular feature, structure, or characteristic described in connection with an embodiment is included in at least one embodiment of claimed subject matter. Thus, appearances of phrases such as "in one embodiment" or "an embodiment" in various places throughout this specification are not necessarily all referring to the same embodiment. Furthermore, particular features, structures, or characteristics may be combined in one or more embodiments.

The present invention pertains to a slip differential cassette for use in "free heel" touring-style ski binding mechanisms and containing a spring or alternative media, wherein such media comprises an elastic, resilient, compressible or semi-compressible media for energy-capture and -return. The slip differential cassette of the present invention has a toe-end and a heel-end and is configured to connect to a touring-style ski binding and to enable a modifiable binding stiffness, responsiveness, and range of motion. The slip differential cassette may also be configured to implement a plurality of re-programmable presets for binding stiffness, responsiveness, and range of motion.

The slip differential cassette includes a cassette cylinder having a first end and a second end, a cassette nut or cassette cap connected to the cassette cylinder at the first end, a cassette piston having a piston head and a piston shaft, a slip differential bolt having a central conduit and configured to thread into the second end of the cassette cylinder, and at least one of a spring and alternative media held within the cassette cylinder between the piston head and the slip differential bolt, wherein the cassette piston shaft passes through the at least one of a spring and alternative media and through the central conduit of the slip differential bolt, which is configured to adjust a compression applied to the at least one of a spring and alternative media.

The slip differential cassette may implement presets for binding responsiveness and ranges of motion, which provide the touring-style skier with predetermined stiffness values according to skier weight, ability, and preference. The slip differential cassette may have one or more default, re-programmable presets where the displacement, or differential slip, of the cassette piston shaft, as energetically restored by the cassette spring and/or alternative media mechanism, is manually modifiable. This provides the touring-style skier with a cassette and binding mechanism adaptable to specific sizes, stiffness, responsiveness, and ranges of motion based on default and re-programmable presets.

The slip differential cassette may be configured to connect to the binding heel-connector and to the one of a binding heel-piece, ski, ski plate, and binding toe-piece via at least two portions provided by one or more of a latch, tubing, solid-core wire, stranded wire, braided wire, cable, cord, chain, band, or other suitable connection mechanism, wherein the at least two portions are configured to connect to the slip differential cassette, the binding heel-connector, and the one of a binding heel-piece, ski, ski plate, and binding toe-piece via one of threading and a flanged head.

The slip differential bolt may be equipped with a slip differential adjustment knob, configured to facilitate manual rotation of the slip differential bolt, and a slip differential lock-nut, configured to lock in place the respective positions of the slip differential bolt and the cassette cylinder. The slip differential cassette may further include a preset gauge viewing panel, wherein the preset gauge viewing panel may be configured to implement at least one of a transparent window, ruled graphical measures, and color coded indicators of relative position.

The preset gauge viewing panel may comprise a transparent window on the side of the cassette cylinder configured to show the interior of the slip differential cassette and permit easy identification of a relative position of the slip differential bolt and a corresponding effective stiffness of the slip differential cassette. At least one of ruled graphical measures and color coded indicators of relative position may be implemented directly on the transparent window of the preset gauge viewing panel.

Alternatively, at least one of ruled graphical measures and color coded indicators of relative position may be implemented via at least one sliding screen mechanism overlaying the transparent window of the preset gauge viewing panel. Additionally, at least one locking mechanism may be configured to lock in place the at least one sliding screen mechanism and thereby enable re-programming of slip differential cassette presets.

The preset gauge viewing panel may further comprise a computer display electrically connected to and in communication with an on-board microcomputer, which is in turn electrically connected to and in communication with a power source, one or more microcomputer input buttons, and at least one of pressure, strain, and stress sensors incorporated in the slip differential cassette. The at least one of pressure, strain, and stress sensors are configured to detect forces applied to and by the at least one of a spring and alternative media.

The microcomputer input buttons may be located next to the preset gauge viewing panel computer display and are configured to electronically input and select specific binding stiffness, responsiveness, and range of motion values. The microcomputer may further include a computer readable medium, which does not comprise solely signals or energy, for saving and selecting information including slip differential cassette stiffness, responsiveness, and range of motion presets as well as real time performance data and other parameters.

A touring-style ski binding may include a toe-piece connected to the top surface of a ski or ski plate and configured to attach to the toe-portion of a ski boot, a heel-piece connected to the top surface of the ski or ski plate and configured to provide a resting place for the heel-portion of the ski boot, at least one slip differential cassette having a toe-end and a heel-end and configured to enable modifiable binding size, stiffness, responsiveness, and range of motion and to implement a plurality of re-programmable presets for binding stiffness, responsiveness, and range of motion, each slip differential cassette including a cassette cylinder having a first end and a second end, a cassette-nut or cassette-cap connected to the cassette cylinder at the first end, a cassette piston having a piston head and a piston shaft, a slip differential bolt, having a central conduit and configured to thread into the second end of the cassette cylinder, at least one of a spring and alternative media held within the cassette cylinder between the piston head and the slip differential bolt, wherein the cassette piston shaft passes through the at least one of a spring and alternative media and through the central conduit of the slip differential bolt, which is configured to adjust a compression applied to the at least one of a spring and alternative media, a heel-connector connected to the at least one slip differential cassette and configured to attach to the heel-portion of the ski boot, wherein the at least one slip differential cassette is also connected to one of the heel-piece, toe-piece, ski plate, and ski.

The at least one slip differential cassette may be configured to connect to the heel-connector and to one of the heel-piece, toe-piece, ski plate, and ski via at least two portions provided by one or more of a latch, tubing, solid-core wire, stranded wire, braided wire, cable, cord, chain, band, or other suitable connection mechanism, wherein the at least two portions are configured to connect to the at least one slip differential cassette, the heel-connector, and the one of the heel-piece, toe-piece, ski plate, and ski via one of threading and a flanged head.

Orientation of the slip differential cassette is invertible with respect to the touring-style ski binding. In certain embodiments, the first end of the cassette cylinder comprises the toe-end of the slip differential cassette and the second end of the cassette cylinder comprises the heel-end of the slip differential cassette. In other embodiments, the first end of the cassette cylinder comprises the heel-end of the slip differential cassette and the second end of the slip differential cylinder comprises the toe-end of the slip differential cassette.

By providing the touring-style skier the ability to manually control the binding size, stiffness, and range of motion, the present slip differential cassette improves touring-style ski binding capabilities. Specifically, the slip differential cassette improves the ease and capacity for binding adjustment while enhancing ski, boot, and binding control during ascent, descent, and traverse movements to advance the sport of skiing.

The objectives, features and advantages of the slip differential cassette will be apparent from the following detailed description of the invention, which is to be read in conjunction with the accompanying drawings. The scope of the invention will be pointed out in the claims. The following drawings, in conjunction with the subsequent description, are presented to enable one of ordinary skill in the art to make and use the present invention and to implement the various embodiments of the present invention.

Various modifications, as well as a variety of uses in different applications, will be readily apparent to those skilled in the art. The general principles, defined herein, may be applied to a wide range of embodiments. Thus, the present invention is not intended to be limited to the embodiments presented, but is to be accorded the widest scope consistent with the principles and novel features disclosed herein. Furthermore, it should be noted that unless explicitly stated otherwise, the figures included herein are illustrated schematically and without any specific scale, as they are provided as qualitative illustrations of the concept of the present invention.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single FIG, and as such, multiple FIGs are presented to separately illustrate the various details of the invention in greater clarity. Similarly, not every embodiment need accomplish all advantages of the present invention.

DETAILED DESCRIPTION

The invention and accompanying drawings will now be discussed so as to enable one skilled in the art to practice the present invention. These, and other, aspects and objects of the present invention will be better appreciated and understood when considered in conjunction with the following description and the accompanying drawings.

It should be understood, however, that the following description, while indicating preferred embodiments of the present invention and numerous specific details thereof, is given by way of illustration and not of limitation. The drawings and following description are exemplary of various aspects of the invention and are not intended to narrow the scope of the appended claims.

For the purposes of this description, "touring-style" means skiing styles, including, but not limited to, telemark skiing, alpine touring, backcountry skiing, ski touring, and Nordic or cross-country skiing, and "touring-style binding" means ski binding equipment for use with ski gear appropriate to any one of these skiing styles.

The disclosed touring-style ski binding, slip differential cassette, and other components will become more thoroughly understood through the claims below and the subsequent detailed description and through elaboration of possible embodiments and configurations. The described embodiments and configurations provide exemplary details of the invention only, which should not in any way be interpreted to limit the invention.

Description of the present invention makes reference to the embodiments and configurations of the included figures. FIGS. 1A-10B illustrate components of the slip differential cassette, or cassette 10 for short, described in the current disclosure. The drawings in the figures are not to scale and are not intended to limit the scope of the invention in any way.

Figure 1A:
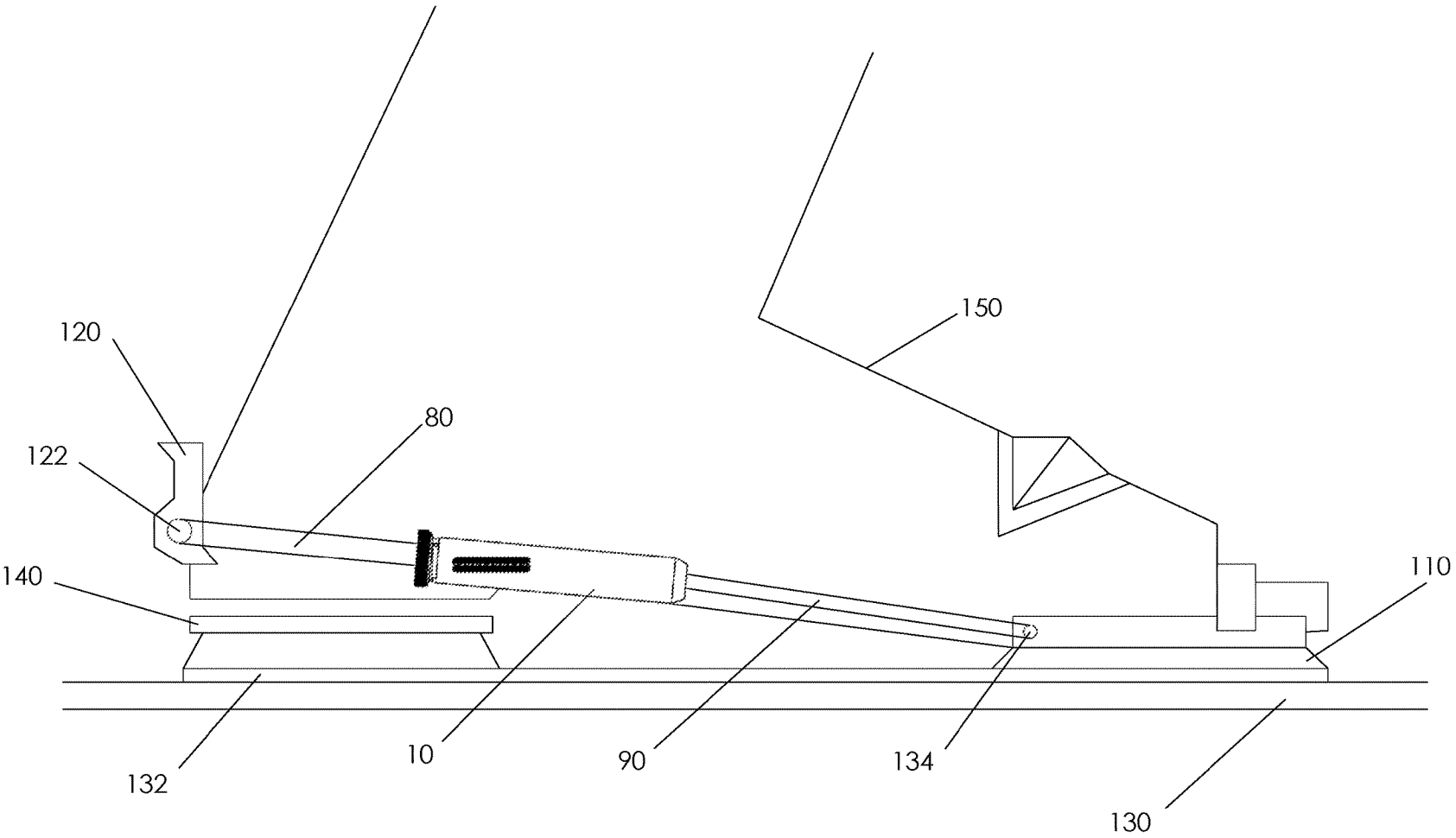
FIGS. 1A and 1B illustrate the individual components of a touring-style ski binding, including the ski, boot and binding components.
Figure 1B:
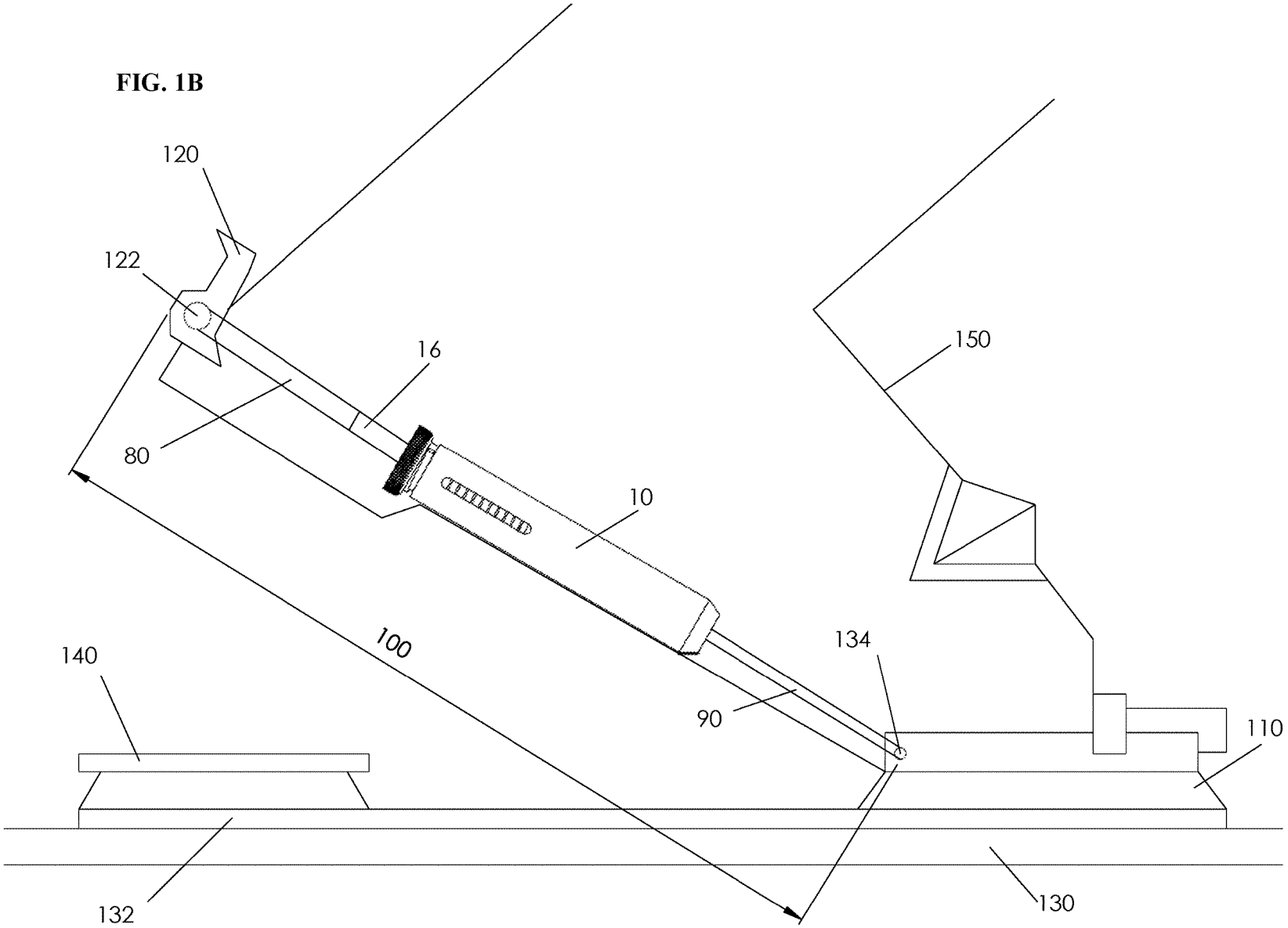

As shown in FIGS. 1A and 1B, the slip differential cassette 10 is for use in a touring-style binding 100, which connects the ski 130 to the ski boot 150 to provide the skier with a "free heel" action. The touring-style ski binding 100 includes at least one slip differential cassette 10, a toe-piece 110, a heel-connector 120, and at least two connecting portions 80 and 90 provided by one or more of a latch, tubing, solid-core wire, stranded wire, braided wire, cable, cord, chain, and band, or other suitable connection mechanisms. Such connecting portions 80 and 90 may be made of metal, alloys, alloy-composites, polycarbonates, synthetic fibers, carbon fibers, fiber reinforced polymer composites including but not limited to carbon fiber reinforced plastics, or other suitable materials.

The binding 100 may also incorporate a binding heel-piece 140, which may be fixedly attached to the top surface of the ski 130, to provide a surface upon which the sole of the heel-portion of the ski boot 150 may rest. The at least two connecting portions 80 and 90 connect the slip differential cassette 10 to the heel-connector 120 and to one of the heel-piece 140, toe-piece 110, ski plate 132, and ski 130, respectively. The at least two connecting portions 80 and 90 may connect to the heel-connector 120 and to one of either the heel-piece 140, toe-piece 110, ski plate 132, and ski 130 via one of threading, a flanged cable head, or other suitably securable connection mechanism.

The touring-style binding 100 attaches to the ski boot 150 at the binding heel-connector 120 and at the binding toe-piece 110 and provides an elastic or semi-elastic "free heel" connection between the heel-portion of the ski boot 150 and the ski 130, ski plate 132, binding toe-piece 110, or binding heel-piece 140. The heel-portion of the ski boot 150 is releasably attached to the touring-style binding 100 at the binding heel-connector 120. The binding toe-piece 110 releasably attaches to the toe of the ski boot 150 and may be fixedly attached, directly or indirectly, to the top surface of the ski 130. When attached indirectly, the binding toe-piece 110 may be fixedly attached to a ski plate 132, which is in turn attached, fixedly or releasably, to the ski. Various embodiments of the touring-style binding 100 may be configured and fabricated to incorporate any binding attachment mechanisms known in the art for securing the binding 100, cassette 10, and ski boot 150 to the ski 130.

In motion, the skier's heel describes an arcuate trajectory, between a resting point, atop the ski 130 or ski plate 132, or on top of a binding heel-piece 140, and a fully extended position. FIG. 1A shows the touring-style ski binding 100 in the resting position with the sole of the heel-portion of the ski boot 150 firmly planted on the top of the binding heel-piece 140. FIG. 1B depicts the touring-style ski binding 100 in the fully extended position with the heel of the ski boot 150 at its furthest position from the heel-piece 140.

The slip differential cassette 10 provides an elastic, resilient, energy-capture-and-return mechanism for use with touring-style ski bindings 100 to provide a restorative force capable of replacing the heel of the ski boot 150 from the fully extended position to a position of contact with the top surface of the ski 130, ski plate 132 or binding heel-piece 140. The cassette 10 comprises a manually adjustable binding component and provides "free heel" touring-style skiers with a modifiable range of binding size, stiffness, responsiveness, and range of motion, extending the capabilities of conventional "free heel" binding cartridges. In some embodiments, the slip differential cassette 10 may be incorporated into a conventional touring-style ski binding 100 as a replacement for conventional binding cartridges.

Figure 2:
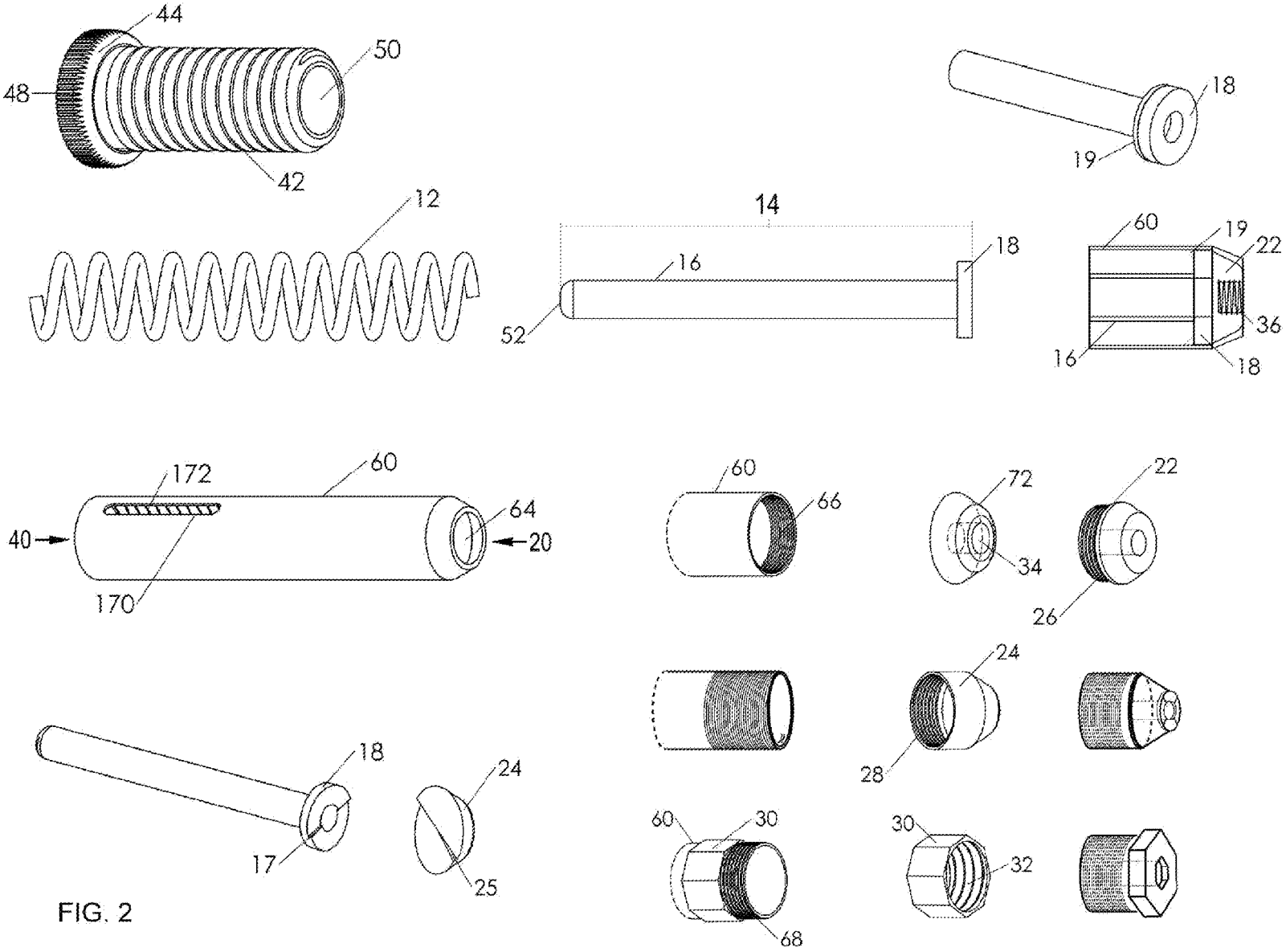
FIG. 2 illustrates the individual elements in the component group of the slip differential cassette shown in FIGS. 1A and 1B using a spring as the elastic, compressible media.

FIG. 2 illustrates components of the slip differential cassette 10 depicted in FIGS. 1A and 1B. FIG. 2 shows in further detail potential configurations and physical characteristics of the slip differential cassette 10 components. Components of the slip differential cassette 10 may include a cassette cylinder 60, a slip differential bolt 42, a spring and/or alternative elastic, resilient compressible media (air, fluid, oil, etc.) 12, a cassette piston 14, having a piston shaft 16 and a piston head 18, and a cassette nut 22 or cassette cap 24. The cassette 10 and binding 100 may additionally include other appropriate components including but not limited to lock-nuts, bolts, nuts, washers, gaskets, seals, and cables or other attachment and connection mechanisms well known in the respective arts, which may or may not be described herein or depicted in the Figures.

The cassette cylinder 60 and other components of the slip differential cassette 10 may be made from any suitable materials. Suitable materials may include but are not limited to ruggedized plastics, polycarbonates, carbon composites, fiber reinforced polymer composites including but not limited to carbon fiber reinforced plastic, and metals, alloys, and alloy-composites that may include but are not limited to aluminum, titanium, steel, and other metallic and non-metallic constituents.

The slip differential cassette 10 employs an elastic or semi-elastic, compressible or semi-compressible, resilient component, including but not limited to a spring, coil, and/or alternative media 12 including but not limited to pneumatic (air) or hydraulic (oil or other liquid) fluid, or other adjustably resilient energy-capture-and-return mechanism to restore the heel position and provides an adjustable range of motion and amount of free-heel extension experienced by the touring-style skier. Springs or coils 12 may be made from any suitable materials including but not limited to metals, including aluminum, titanium, and steel, alloys, and composites, including but not limited to alloy-composites and fiber reinforced composites, and other high-compressive/high-tensile strength materials.

Figure 3A:
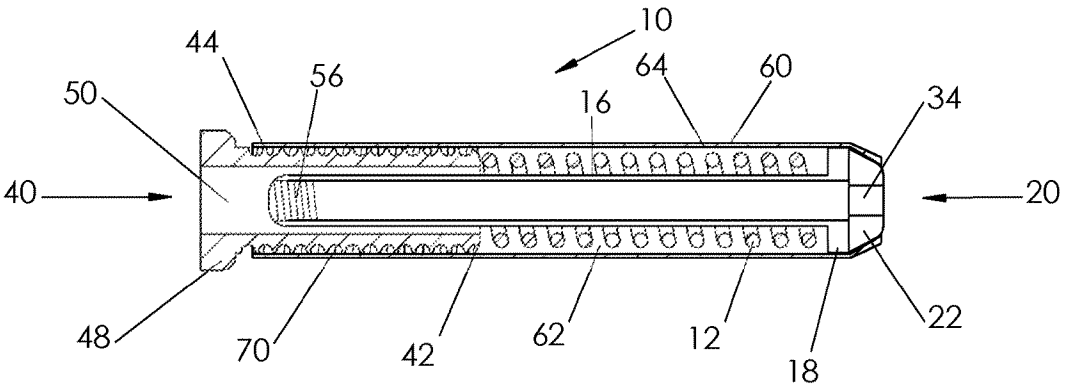
FIGS. 3A, 3B, and 3C illustrate an embodiment of the slip differential cassette in cross-section with the cassette set to one of three default presets; pro (A), expert (B), and tour (C), having a cassette chamber containing a spring as the elastic, resilient, compressible media.
Figure 3B:
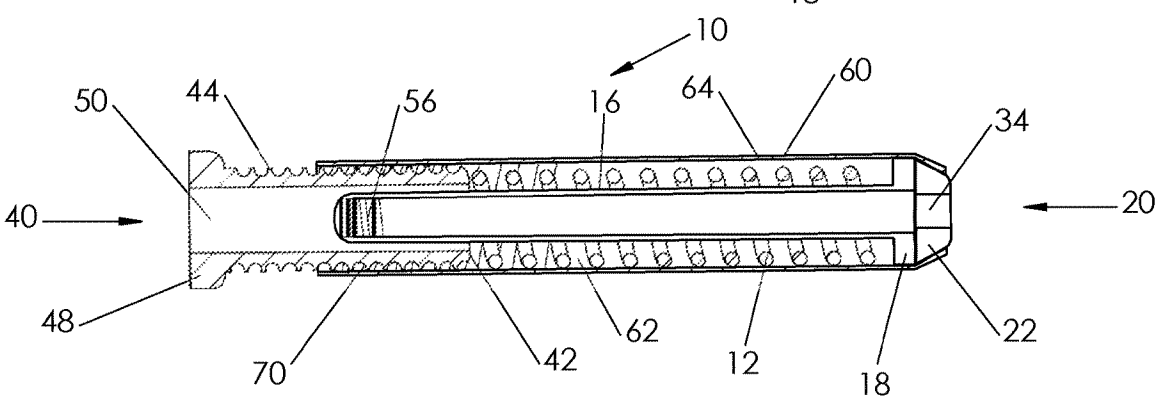
Figure 3C:
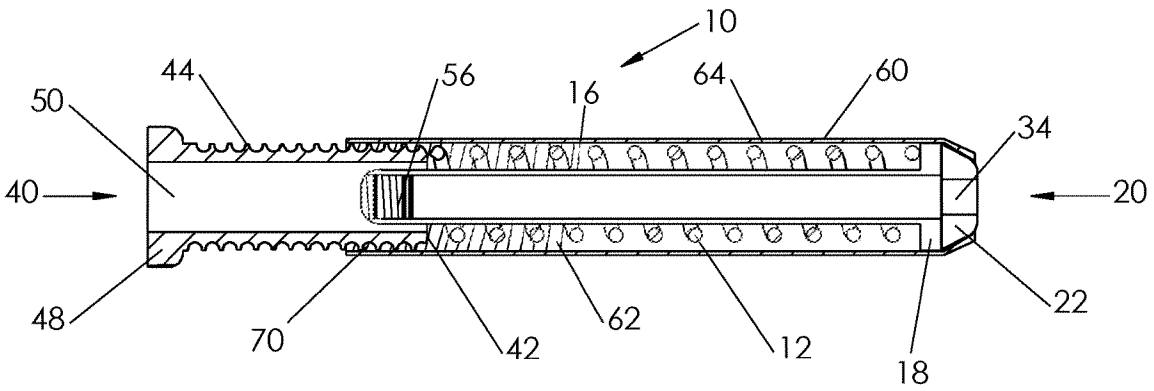
Figure 4A:
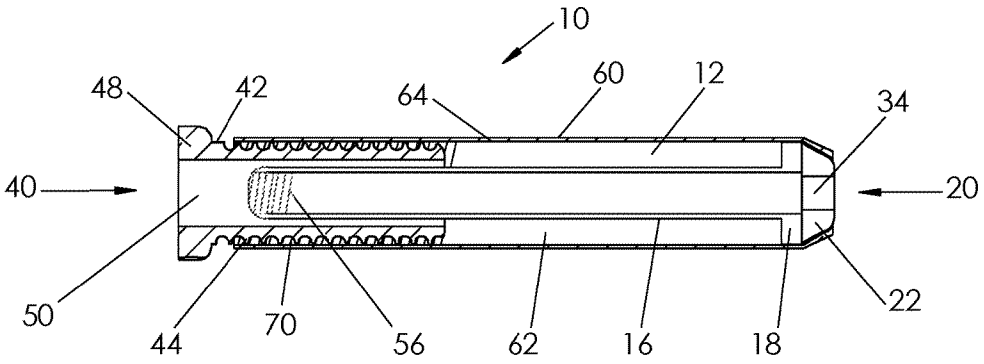
FIGS. 4A, 4B, and 4C illustrate an embodiment of the slip differential cassette in cross-section with the cassette set to one of three default presets; pro (A), expert (B), and tour (C), having a cassette chamber containing a hydraulic or pneumatic fluid as the elastic compressible media.
Figure 4B:
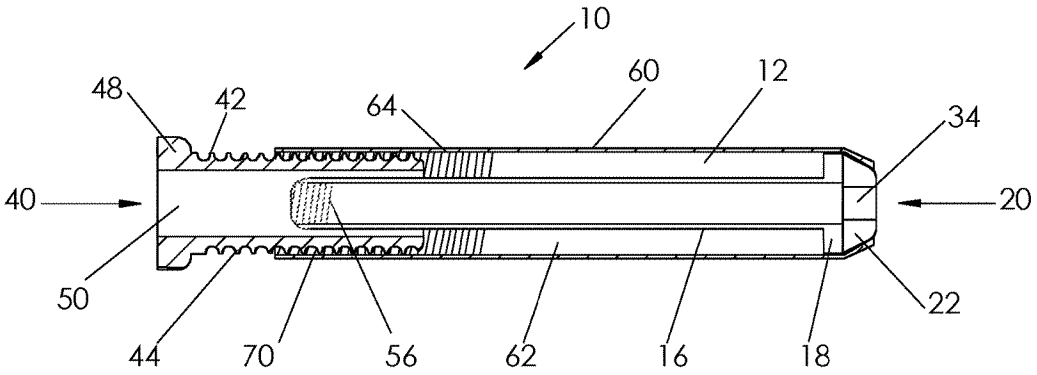
Figure 4C:
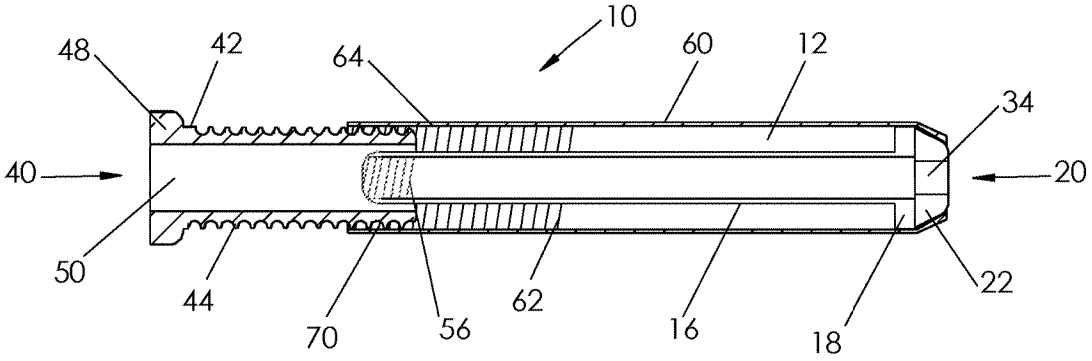

As depicted in FIGS. 3A-3C and FIGS. 4A-4C, the volume internal to the cassette cylinder 60 and contained by the cassette piston shaft 16, cassette piston head 18, and the slip differential bolt 42 comprises the cassette chamber 62. The cassette chamber 62 holds the spring and/or alternative media 12. When the cassette piston 14 is actuated by the striding motion of a skier, e.g. when a skier lifts the heel of a ski boot 150, the piston head 18 compresses the spring and/or alternative media 12, as shown in FIGS. 3A and 4A. Skier striding motion actuates the cassette piston 14 of the slip differential cassette 10 by applying a compressive force to the spring and/or alternative media 12, which in turn applies a resilient, restorative force upon the cassette piston head 18 to pull the heel of the ski boot 150 back to the starting position on the surface of the ski 130 or ski plate 132, or a binding heel-piece 140 attached thereto.

The slip differential cassette 10 provides the skier with re-programmable default presets and the capability to manually select or adjust presets to modify stiffness, responsiveness, and range of motion. Presets can be based on rider ability (style), preference, weight, and boot type. FIGS. 3A-3C and 4A-4C depict various settings for the slip differential cassette 10 stiffness and selected range of motion, including pro (FIG. 3A/4A), expert (FIG. 3B/4B), and tour (FIG. 3C/4C). When the slip differential bolt 42 is advanced, as illustrated in FIG. 3A/4A, or retracted, as illustrated in FIG. 3C/4C, the spring and/or alternative media 12 is respectively compressed, FIG. 3A/4A, or released, FIG. 3C/4C, effectively modifying the stiffness and range of motion, i.e. action, of the slip differential cassette 10.

The cassette cylinder 60 comprises a hollow open-ended cylinder having a first end 20 and a second end 40. In standard orientation embodiments, the first end 20 of the cassette cylinder 60 comprises a toe-end and the second end 40 of the cassette cylinder 60 comprises a heel-end, as shown in FIG. 1A, FIG. 1B, and FIG. 2. In alternative orientation embodiments, the orientation of the cassette 10 may be inverted such that the first end 20 and second end 40 of the cassette cylinder 60 may be reversed with respect to the configurations of the exemplary embodiments as shown in FIGS. 1A and 1B and detailed herein. In such alternative orientation embodiments, not depicted in the Figures, the first end 20 of the cassette cylinder 60 comprises a heel-end and the second end 40 of the cassette cylinder 60 comprises a toe-end, with respect to the ski binding 100 depicted in FIG. 1A and FIG. 1B.

Figure 7A:
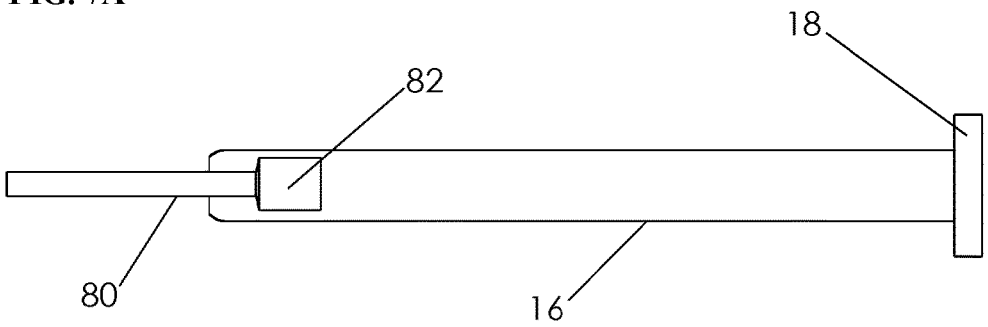
FIGS. 7A, 7B, 7C, and 7D illustrate the slip differential cassette piston shaft, including 3 different cable mount attachment mechanisms.
Figure 7B:
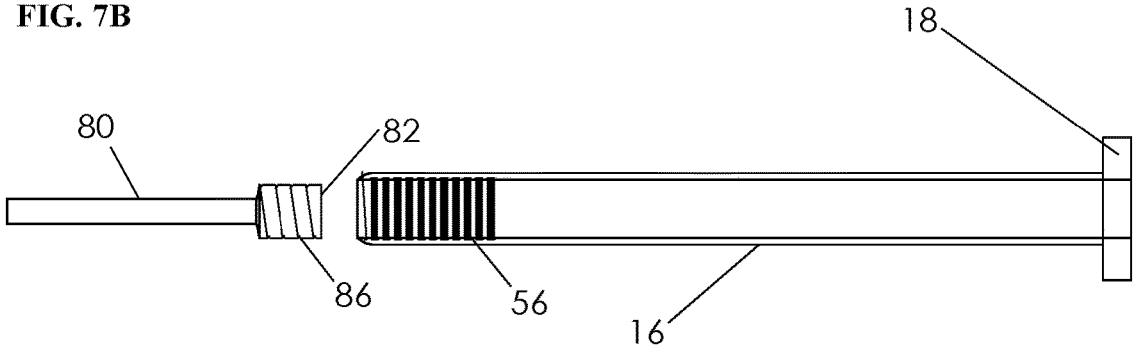

In alternative embodiments, the cassette cylinder 60 may be doubly open-ended, i.e. open on both the first end 20 and the second end 40, or it may be singly open-ended, i.e. open only on the second end 40 (FIG. 2 and FIGS. 7A-7B). In either of these alternative embodiments, the slip differential bolt 42 is configured to thread into the cassette cylinder 60 at the open second end of the cylinder 60. The slip differential bolt 42 controls the magnitude of the displacement or action of the spring and/or alternative media 12 during the skier striding motion.

In doubly open-ended embodiments, the cassette nut 22 or cassette cap 24 may be releasably attached at the first end 20 of the cassette cylinder 60 via threading, or any other means conventionally known in the art. Alternatively, the cassette nut 22 or cassette cap 24 may be affixedly attached at the first end 20 of the cassette cylinder 60 via epoxy or other high-tensile bonding, adhesive, welding, or any other means conventionally known in the art. In doubly open-ended embodiments, where the cassette nut 22 or cassette cap 24 attaches to the cassette cylinder 60 via threading the exterior surface of the cassette nut 22 or cassette cap 24 or the interior surface of the cassette nut 22 may be equipped to receive a tool interface, including but not limited to a hex wrench or a screwdriver head, such as a Philips head or a flat head.

In doubly open-ended embodiments having a cassette nut 22, the cassette nut 22 forms a plug that matches the interior surface 64 of the first end 20 of the cassette cylinder 60. The first end 20 of the cassette cylinder 60 may be tapered to help contain and protect the components internal to the cassette cylinder 60 from wear and tear due to weather, environmental, and terrain conditions. In embodiments where the first end 20 of the cassette cylinder 60 is tapered, the cassette nut 22 can take the form of a truncated cone, having a roughly trapezoidal cross-section, or the form of a truncated cone atop a cylinder, having a cross section of a trapezoid atop a rectangular base.

The cassette nut 22 may incorporate a cylindrical portion of male threading 26, extending from the base of the truncated conical plug, for threading into a corresponding portion of female threading 66 on the interior surface 64 of the cassette cylinder 60. Alternatively, where the first end 20 of the cassette cylinder 60 is not tapered, the cassette nut 22 may have a wholly cylindrical form-factor, or other appropriate shape.

The cassette nut 22 is partially enclosed by the boundary of the physical interface between the cassette nut 22 and the cassette cylinder 60 at the first end 20 of the cassette cylinder 60. In preferred embodiments, the cassette nut 22 forms an airtight or nearly airtight seal, with the interior surface 64 and/or the portion of female threading 66 at the first end 20 of the cassette cylinder 60.

Alternatively, instead of having a cassette nut 22 secured to the interior surface 64 of the first end 20 of the cassette cylinder 60, a cassette cap 24 may be secured to the exterior of the first end 20 of the cassette cylinder 60, either by threading or other appropriate means. In doubly open-ended embodiments having a cassette cap 24, the exterior of the first end 20 of the cassette cylinder 60 may be equipped with a portion of male threading 68 and the cassette cap 24 may be equipped with corresponding female threading 28 for respectively receiving the first end 20 of the cassette cylinder 60.

In preferred embodiments, the cassette cap 24 forms an airtight or nearly airtight seal with the first end 20 of the cassette cylinder 60. Additionally, a cassette lock-nut 30 may be included, with female threading 32 to ride along the portion of male threading 68 at the first end 20 of the cassette cylinder 60, to lock in place the relative positions of the cassette cylinder 60 and the cassette cap 24.

Figure 8A:
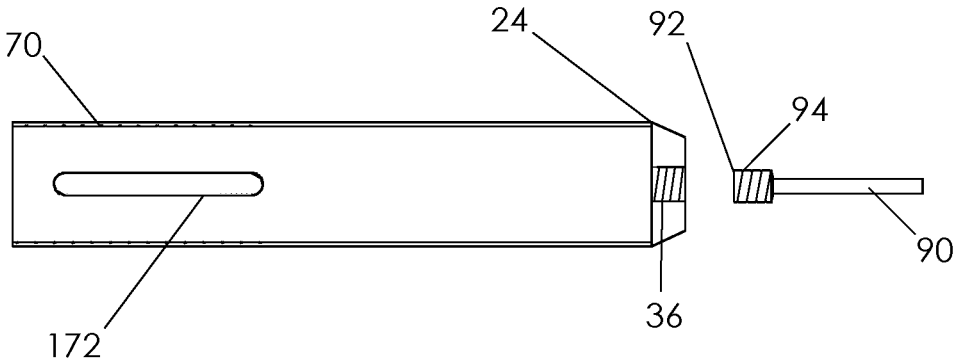
FIGS. 8A, 8B, and 8C illustrate the slip differential cassette cylinder, including 3 different cable mount attachment mechanisms applicable to either cassette nut or cassette cap embodiments.
Figure 8B:
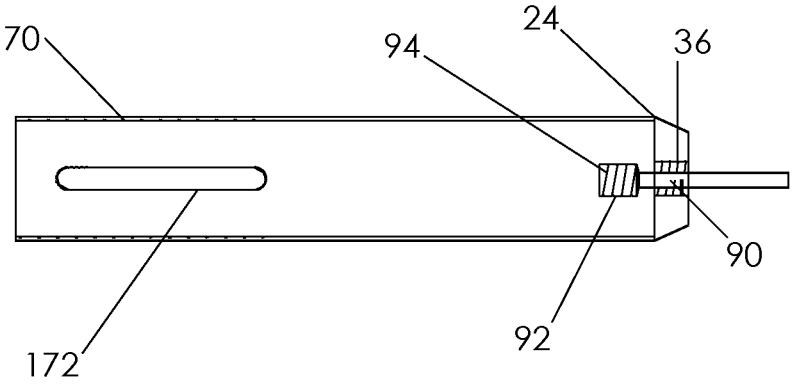
Figure 8C:
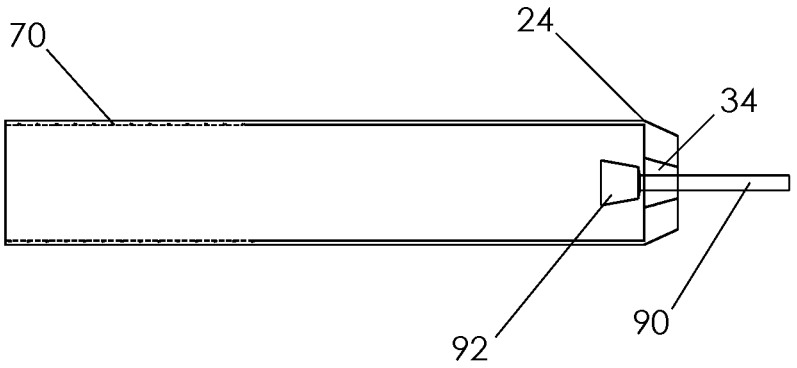

As shown in FIGS. 8A-8C, for singly-open ended embodiments, the cassette cap 24 and the first end 20 of the cassette cylinder 60 may be physically joined to form a single solid piece. In these embodiments, the first end 20 of the cassette cylinder 60 includes a solid portion that forms a cassette cap 24 that is not physically separate from the body of the cassette cylinder 60. This means that in singly open ended embodiments the first end 20 of the cassette cylinder 60 and the cassette cap 24 are physically integrated and joined together, there being no physical boundary or interface separating the first end 20 of the cassette cylinder 60 and the cassette cap 24 as there is between the interior of the cassette cap 24 and the exterior of the first end 20 of the cassette cylinder 60 in doubly open-ended embodiments.

The slip differential bolt 42 is equipped with a portion of male threading 44, which threads into a corresponding portion of female threading 70 formed on the interior surface 64 of the cassette cylinder 60 at the second end 40 of the cassette cylinder 60. In preferred embodiments, the portion of male threading 44 on the slip differential bolt 42 makes an airtight seal, or nearly airtight seal, with the portion of female threading 70 at the second end 40 of the cassette cylinder 60.

As depicted in FIGS. 3A-3C and FIGS. 4A-4C, the portion of male threading 44 is partially enclosed by the cassette cylinder 60 and a slip differential lock-nut 46 equipped with female threading 58 rides along the portion of male threading 44 not enclosed by the cassette cylinder 60. The slip differential lock-nut 46 functions to lock in place the relative positions of the slip differential bolt 42 and the cassette cylinder 60. A slip differential adjustment knob 48, for manually advancing and retracting the slip differential bolt 42 along the portion of female threading 70 within the cassette cylinder 60, is located at the exterior end of the slip differential bolt 42, which protrudes from the second end 40 of the cassette cylinder 60.

Manually advancing and retracting the slip differential bolt 42, as shown in FIGS. 3A-3C and 4A-4C, adjusts the effective displacement and responsiveness of the spring and/or alternative media 12 and provides the slip differential cassette 10 with the ability to control stiffness, responsiveness, and range of motion. Compressing the cassette spring and/or alternative media 12 increases the binding stiffness and releasing the spring and/or alternative media 12 decreases binding stiffness, while binding responsiveness and range of motion becomes less or more active, respectively.

The slip differential bolt 42 has a central conduit 50, which comprises a hollow channel along the central longitudinal axis of the slip differential bolt 42. The cassette piston shaft 16 passes through and slides along the central conduit 50, allowing the striding motion of the skier to actuate the cassette piston 14 and to alternately compress and release the spring and/or alternative media 12. In preferred embodiments, the surface of the central conduit 50 makes an airtight or nearly airtight seal with the surface of the cassette piston shaft 16.

The cassette piston shaft 16 extends along the length of the central axis of the cassette cylinder 60 from beyond the exterior end of the slip differential bolt 42 at the slip differential bolt adjustment knob 48, through the slip differential bolt central conduit 50 and inside the spring and/or alternative media 12, to the piston head 18. The head-end, or top surface of the piston head 18 rests against the interior facing surface of the cassette nut 22 or the cassette cap 24.

The diameter of the cassette piston shaft 16 increases to form the piston head 18 at the interior end of the piston shaft 16 between the spring and/or alternative media 12 and the interior facing surface of the cassette nut 22 or cassette cap 24. The cassette piston head 18 can incorporate a beveled edge 19 having an outer circumference congruent with the outer circumference of the piston head 18, on the piston shaft side of the piston head 18. The outer circumference of the piston head 18 and beveled edge 19 makes contact with and slides along the interior surface 64 of the cassette cylinder 60. The inner circumference of the beveled edge 19 accommodates the diameter of the spring and/or alternative media 12 and may precisely and snugly fit around the outer circumference of the spring and/or the alternative media 12.

In doubly open-ended embodiments having a cassette nut 22, the interior surface 64 of the cassette cylinder 60 is smooth between the portion of female threading 66 and the portion of female threading 70. In doubly open-ended embodiments having a cassette cap 24 or in singly open-ended embodiments, the interior surface of the cassette cylinder 60 is smooth between the interior facing surface of the cassette cap 24 and the portion of female threading 70.

The smooth interior surface 64 of the cassette cylinder 60, in combination with a smooth outer circumference of the cassette piston head 18 and beveled edge 19, allows the cassette piston head 18 and beveled edge 19 to easily slide back and forth along the cylinder interior surface 64. The cassette piston head 18 may be composed of a friction reducing material, or alternatively the outer circumference of the cassette piston head 18 may be coated in an appropriate friction reducing material known in the art. Alternatively, the outer circumference of the cassette piston head 18 may incorporate a friction reducing apparatus such as a piston ring and/or piston seal, or even ball bearings. In preferred embodiments the outer circumference of the piston head 18 and beveled edge 19 makes an airtight or nearly airtight seal with the smooth interior surface 64 of the cassette cylinder 60.

Figure 5A:
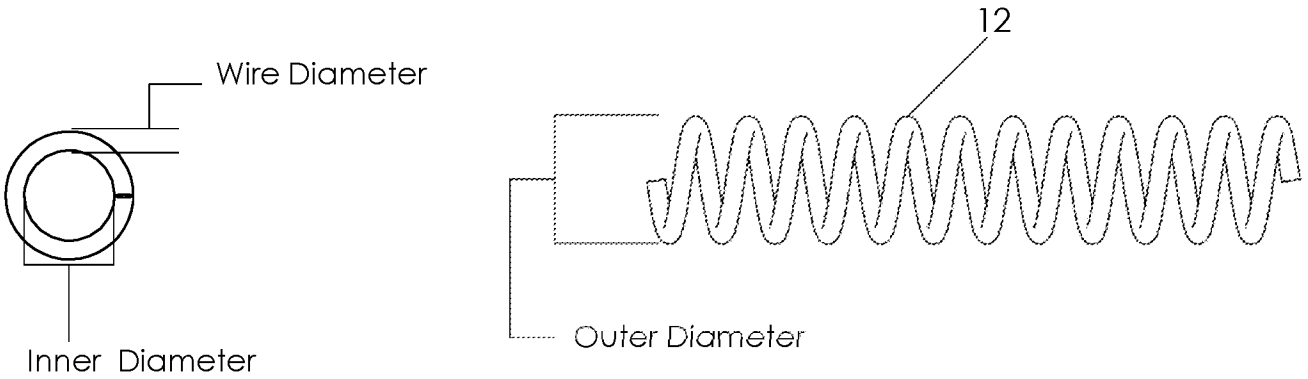
FIG. 5A demonstrates some of the spring parameters that determine the spring constant.

The outer diameter of the spring 12 is limited only by the interior surface 64 of the cassette cylinder 60 or the inside circumference of the beveled edge 19, depending on the particular embodiment. The inner diameter of the spring is theoretically limited only by the diameter of the cassette piston shaft 16. Along with the physical properties of the spring material and average spring coil diameter, spring parameters, as shown in FIG. 5A, including but not limited to mean coil diameter, spring thickness or gauge of the spring wire, the number of active coils, free length of the spring, and the spacing between each of the individual coils also contribute to the spring constant or rate, compressive resistance, and total potential displacement of the spring 12 and the spring's corresponding ability to capture potential energy. In certain preferred embodiments, the spring 12 may have a thick gauge for a greater strength and a wide spacing between each of the coils to allow and increased range of compression and resilient adjustment.

Figure 5B:
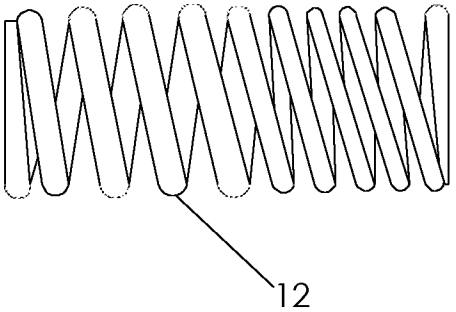
FIG. 5B depicts an example of a variable pitch spring.
Figure 5C:
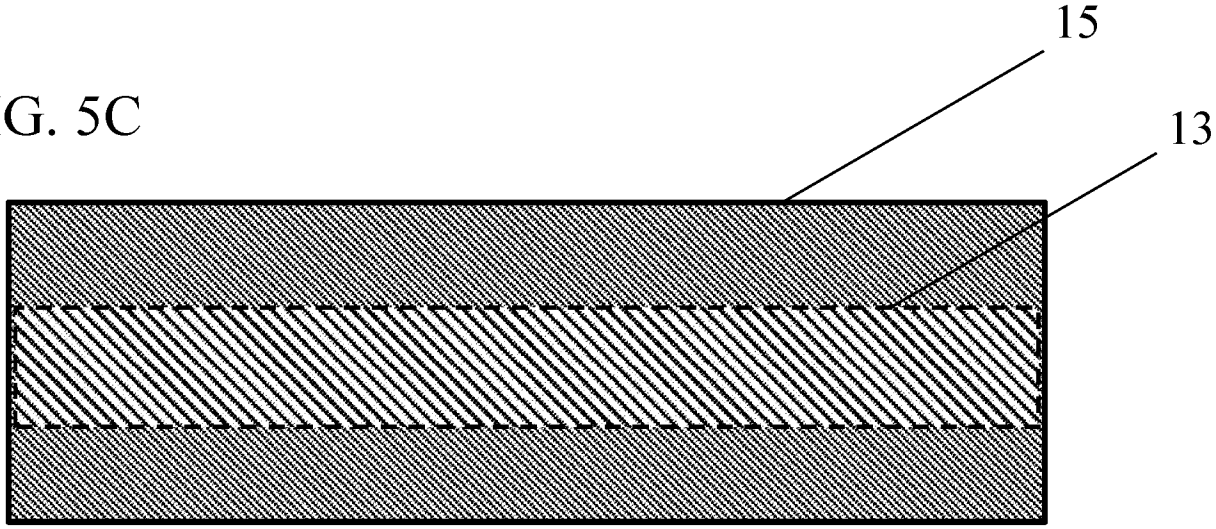
FIG. 5C depicts a generic concept for a spring nested inside another spring and FIG. 5D depicts a specific example of a spring nested inside another spring in cross section.
Figure 5D:
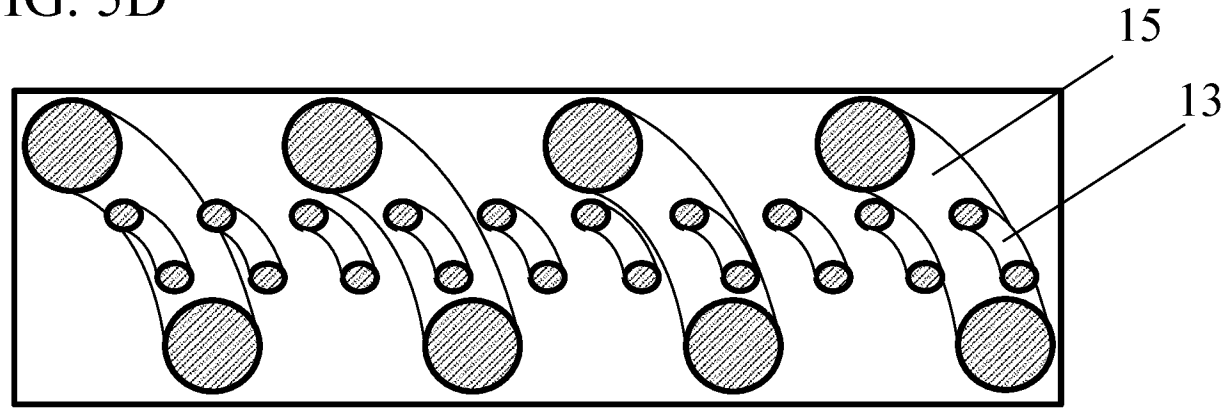
Figure 6A:
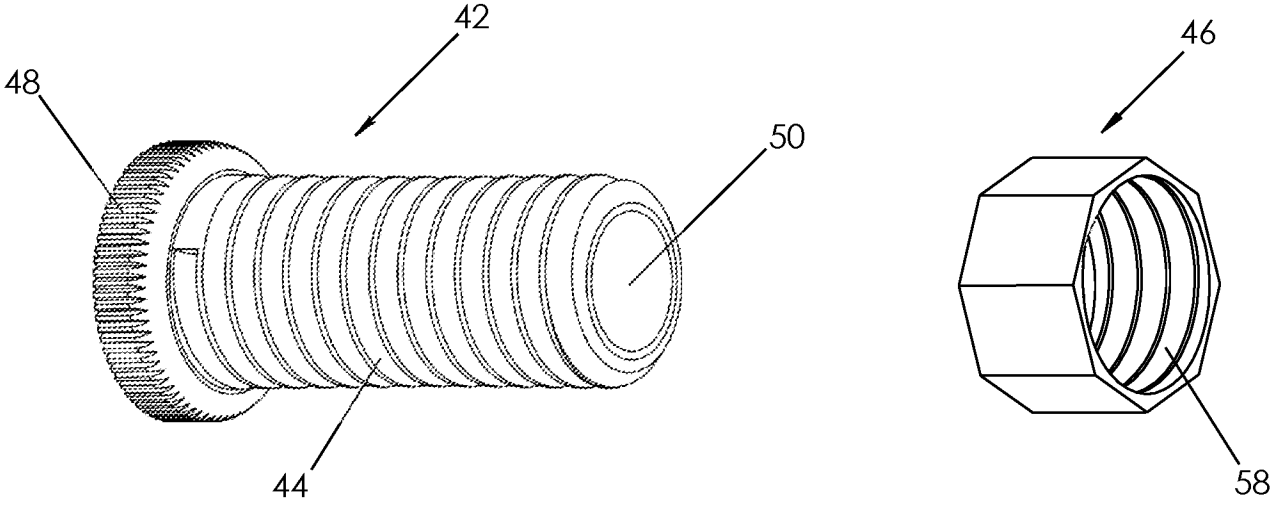
FIGS. 6A and 6B illustrate the individual components of the slip differential cassette stiffness adjustment mechanism, including the slip differential bolt, the slip differential locknut, and a cassette cylinder cut-away showing the preset gauge viewing panel.
Figure 6B:
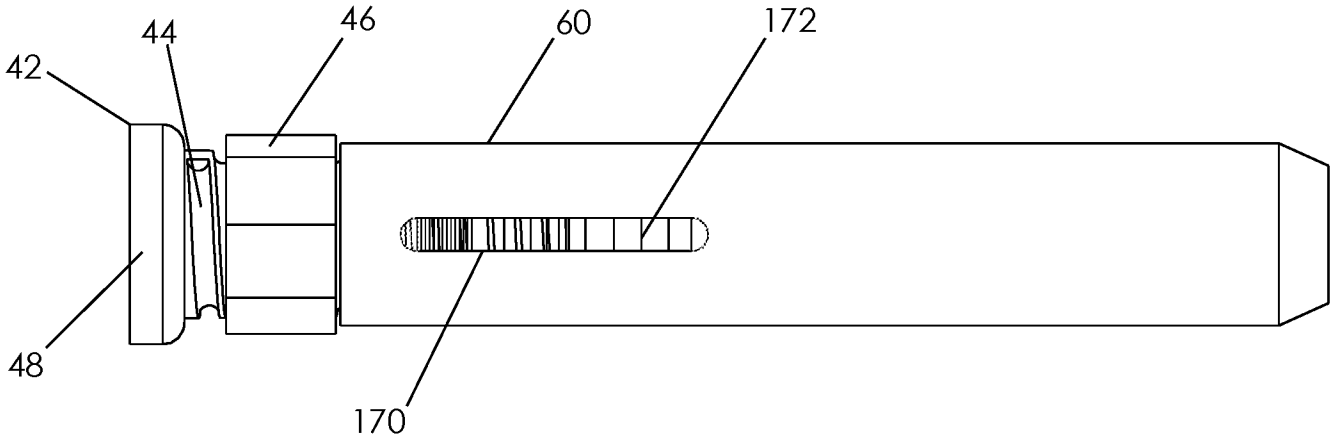

In certain preferred embodiments, the cassette chamber 62 may be loaded with at least one variable pitch spring, or a spring 12 that has a variable average distance between the active coils, as shown in FIG. 5B, Additionally, the cassette chamber 62 may be loaded with at least one spring 12 that has a variable average coil diameter and/or variable average spring gauge/thickness. the cassette chamber 62 may be loaded with two or more nested cassette springs 12, one set inside of another. In multiple spring embodiments, the springs may have different parameters and spring constants to produce a graduated or graded, staged stiffness and responsive action of the binding mechanism, upon compression of the springs 12 by the cassette piston head 18.

In other preferred embodiments, the cassette chamber 62 may be loaded with two or more nested cassette springs 12, one set inside of another. In multiple spring embodiments, the springs may have different parameters and spring constants to produce a graduated or graded, staged stiffness and responsive action of the binding mechanism, upon compression of the springs 12 by the cassette piston head 18. In other preferred embodiments, the cassette chamber 62 may be loaded with at least one variable pitch spring, or a spring 12 that has a variable average distance between the active coils, as shown in FIG. 5B. Additionally, the cassette chamber 62 may be loaded with at least one spring 12 that has a variable average coil diameter and/or variable average spring gauge/thickness. In additional preferred embodiments, the cassette chamber 62 may be loaded with at least one spring 12 and an alternative media 12, including but not limited to a hydraulic or pneumatic fluid.

In embodiments employing alternative media 12, such as hydraulic or pneumatic fluids, or in cases where the alternative media 12 would be capable of escaping the cassette chamber 62, the interior of the slip differential cassette 10 may be hermetically sealed, i.e. sealed airtight, or at least sealed to such a degree as to prevent the media 12 from escaping the cassette cylinder 60. In embodiments employing hydraulic or pneumatic alternative media 12, the composition of the alternative media 12, i.e. oil, air, and/or other fluid, determines the stiffness and responsiveness of the slip differential cassette 10.

In embodiments employing hydraulic or pneumatic media 12, multiple cassette chambers 62 may be implemented, as is well known in the respective arts. Each cassette chamber 62 may be separated from the other cassette chambers 62 by valves, gaskets, seals or other appropriate mechanisms known in the art.

In certain preferred embodiments, the at least two connecting portions 80 and 90 comprise cables. The exterior end of the cassette piston shaft 16, or the end of the piston shaft 16 opposite the cassette piston head 18, incorporates a cable mount. At one end, the cable 80 attaches to the piston shaft 16 cable mount via a cable-head 82 and at the other end of the cable 80 to an anchor point 122 located on the heel-connector 120.

In certain preferred embodiments the cassette piston shaft 16 comprises a hollow cylinder connected to the piston head 18. As shown in FIG. 7A, the inside surface of the cassette piston shaft 16 may be tapered at the cable mount to receive and hold in place a flanged cable-head 82 of the binding cable 80. In such embodiments, the piston head 18 has a central aperture through which the cable and flanged cable head pass, such that the cable also passes through the tapered cable mount at the exterior end of the piston shaft 16, but the flanged cable-head 82 does not.

Figure 7C:
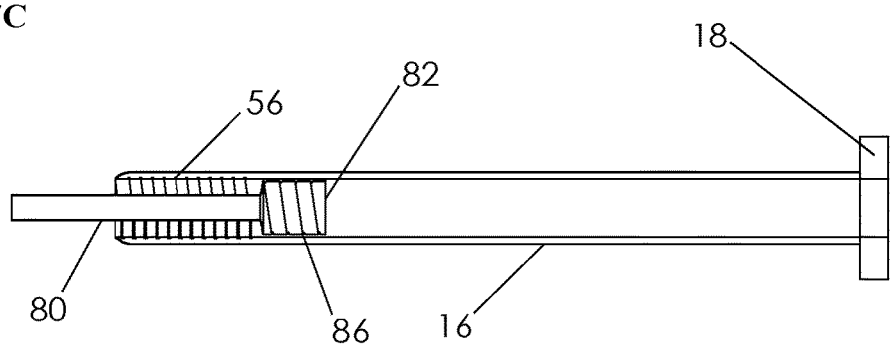

As shown in FIGS. 7B and 7C, the inside surface of the cassette piston shaft 16 includes a portion of female threading 56 comprising the cable mount and the cable-head 82 includes a corresponding portion of male threading 86. As depicted in FIG. 7B, the cable-head 82 is threaded into the piston shaft 16 from the exterior end. As depicted in FIG. 7C, the cable and cable-head 82 pass through a central aperture in the cassette piston head 18 and through the cassette piston shaft 16, such that the cable-head 82 threads into the cable mount at the exterior end of the piston shaft 16.

Respectively advancing and retracting the male threading within the female threading adjusts extension of the binding cable 80 and binding heel-connector 120, and therefore binding size. Similarly to the slip differential bolt lock-nut 46 which rides on the slip differential bolt 42 portion of male threading 44 and the cassette lock-nut 30 which rides on the cassette cylinder 60 portion of male threading 68, a cable lock-nut may be implemented to lock in place the respective positions of the cable 80 and the cable mount of the cassette piston 14.

Figure 7D:
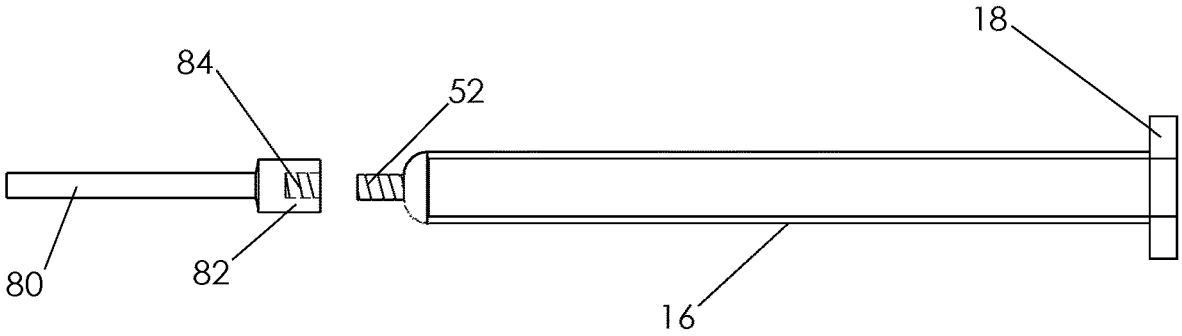

As shown in FIG. 7D, in some embodiments the cable mount may comprise a male threaded portion 52 at the exterior end of the piston shaft 16 and the cable-head 82 includes a corresponding female threaded portion 84.

In both singly open-ended and doubly open-ended embodiments the cassette nut 22 or cassette cap 24 may incorporate a cable mount designed to attach to the cable 90 and a corresponding cable-head 92, as shown in FIGS. 8A-8C. The cable 90 attaches to the cable mount of the cassette nut 22 or cassette cap 24 at the cable-head 92 and at the other end of the cable 90 to an anchor point 134 located on the ski 130, or on the heel-piece 140, toe-piece 110, or other component including but not limited to a ski plate 132, affixed to the ski 130. In certain preferred embodiments, the cables 80, 90 attach to the anchor points 122, 134, respectively, with a free spinning connection, including but not limited to a flanged cable-head/tapered-aperture connection.

As depicted in FIG. 8C, the cable mount may comprise a tapered central aperture 34 for receiving and anchoring a flanged cable-head 92. With the flanged cable-head 92 anchored in the tapered central aperture 34 of the cable mount, the cable 90 passes through the central aperture 34 of the cassette nut 22 or cassette cap 24 and through the first end 20 of the cassette cylinder 60 to attach to the anchor point 134.

The cable-head 92 may include a portion of male threading 94 designed to thread into a portion of female threading 36 comprising the cable mount of the cassette nut 22 or cassette cap 24. As shown in FIGS. 8A and 8B, the male threading 94 may thread into the cable mount from the exterior facing surface or from the interior facing surface of the cassette nut 22 or cassette cap 24.

In certain preferred embodiments, the cable mount comprises a portion of female threading 36 recessed below the exterior surface of the cassette nut 22 or cassette cap 24, which does not penetrate all the way through to the interior facing surface of the cassette nut 22 or cassette cap 24. By having the female threading 36 of the cassette nut 22 or cassette cap 24 cable mount not penetrate all the way through to the interior facing surface of the cassette nut 22 or cassette cap 24, the airtight nature of the interior of the cassette cylinder 60 and cassette chamber 62 is preserved.

In preferred embodiments, the slip differential cassette cylinder 60, the cassette nut 22 or the cassette cap 24, the cable-head 92, the central conduit 50 of the slip differential bolt 42, and the cassette piston shaft 16, all make an airtight or nearly airtight seal with all other respective components.

The cable mounts, respectively of the cassette piston shaft 16 and cassette nut 22 or cassette cap 24, and the cable heads 82, 92 may be configured to accommodate any suitable connection mechanism known in the art. Likewise, the connections between the cables 80, 90 and the anchor points, 122, 134, respectively, may be configured to accommodate any suitable attachment mechanisms known in the art.

The cassette piston 14 interfaces with the interior facing surface of the cassette nut 22 or cassette cap 24 at the head-end surface of the piston head 18. The interior facing surface of the cassette nut 22 or cassette cap 24 may be topologically configured to engagedly interlock with the head-end surface of the piston head 18.

For instance, the head-end surface of the cassette piston head 18 may be equipped with split, half-circular, cross-tilted faces 17 for preferential alignment with corresponding split, half-circular, cross-tilted faces 25 provided on the interior facing surface of the cassette nut 22 or cassette cap 24. Any suitable configuration of engagedly interlocking surfaces can be used in forming the interior facing surface of the cassette nut 22 or cassette cap 24 and the head-end surface of the piston head 18.

In certain preferred embodiments, including but not limited to embodiments having the configuration of interlocking split, half-circular, cross-tilted faces, 17 and 25, the interlocking mechanism will encourage a preferential direction of spin of the cassette piston 14. Such preferential direction of spin can be configured to operate to maintain the locked positions of the various cable mounts in embodiments where the cables 80 and 90 are respectively fixedly connected to the anchor points 122 and 134, such that the cables 80 and 90 do not spin freely with respect to the anchor points 122 and 134. In other words, the preferential spinning of the cassette piston may be configured to tighten the connections between the various cable mounts, cable heads, and other components of the slip differential cassette 10.

In certain preferred embodiments the slip differential cassette 10 may be configured to select from among one or more default presets by manually adjusting the slip differential adjustment knob 48 to rotate the slip differential bolt 42 clockwise or counterclockwise, to respectively advance or retract the slip differential bolt 42. The slip differential bolt 42 may be equipped with a slip differential lock-nut 46, depicted in FIGS. 6A and 6B, capable of locking in place the relative positions of the slip differential bolt 42 and the cassette cylinder 60, corresponding to a particular preset or degree of stiffness desired by the skier.

The slip differential cassette 10 is engaged by lifting the heel of the ski boot 150, thereby extending the binding 100, actuating the cassette piston 14, and compressing the at least one of a spring and alternative media 12 with the cassette piston head 18. Binding stiffness, responsiveness and range of motion can be precisely controlled by setting the slip differential bolt 42, which is capable of being precisely locked to individual skier preferences with the help of a preset gauge viewing panel 170 and the slip differential lock-nut 46.

In certain preferred embodiments, presets may be implemented, (re-)programmed, and selected via a preset gauge viewing panel 170, shown in FIGS. 2, 6B, 9A, 9B, 10A, and 10B on the side of the cassette cylinder 60. The preset gauge viewing panel 170 may be configured to implement at least one of a transparent window, ruled graphical measures, and color coded indicators of relative position.

When implemented as a transparent window on the side of the cassette cylinder 60, the preset gauge viewing panel 170 shows the interior of the slip differential cassette 10 and the cassette chamber 62 to allow the skier to easily identify the relative positions of the slip differential bolt 42 and the spring and/or alternative media 12 and the corresponding effective stiffness of the slip differential cassette 10. To aid in the ability to consistently determine a precise relative position of the slip differential bolt 42, at least one of ruled graphical measures and color coded indicators of relative position may be implemented directly on the transparent window of the preset gauge viewing panel 170.

Ruled graphical measures may include, but are not limited to, linear delineations, logarithmic scale delineations, other exponential scale delineations, and combinations of the various aforementioned delineations. Color coded indicators of relative position may include but are not limited to differentiated color zones configured to indicate specific relative positions of the slip differential bolt 42 and the spring and/or alternative media 12 and corresponding ranges of cassette stiffness, responsiveness, and range of motion. Additionally, the slip differential bolt 42 may also be delineated with ruled markings or color coding indicators of relative position and presets for stiffness and range of motion.

Figure 9A:
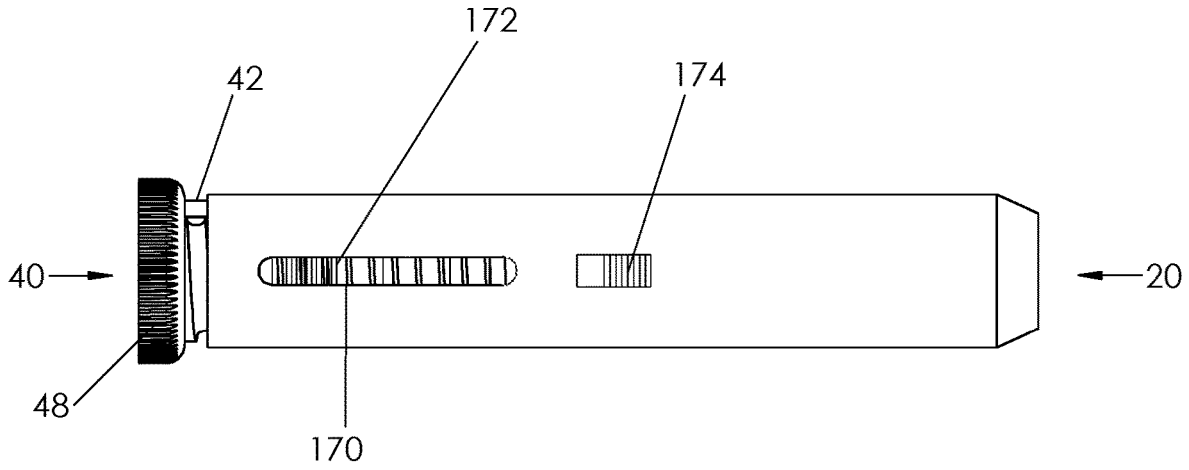
FIGS. 9A and 9B illustrate the slip differential cassette, including the lockable sliding screen, overlying the preset gauge viewing panel window, and a screen locking mechanism for locking the sliding screen into place to physically program preset ranges.
Figure 9B:
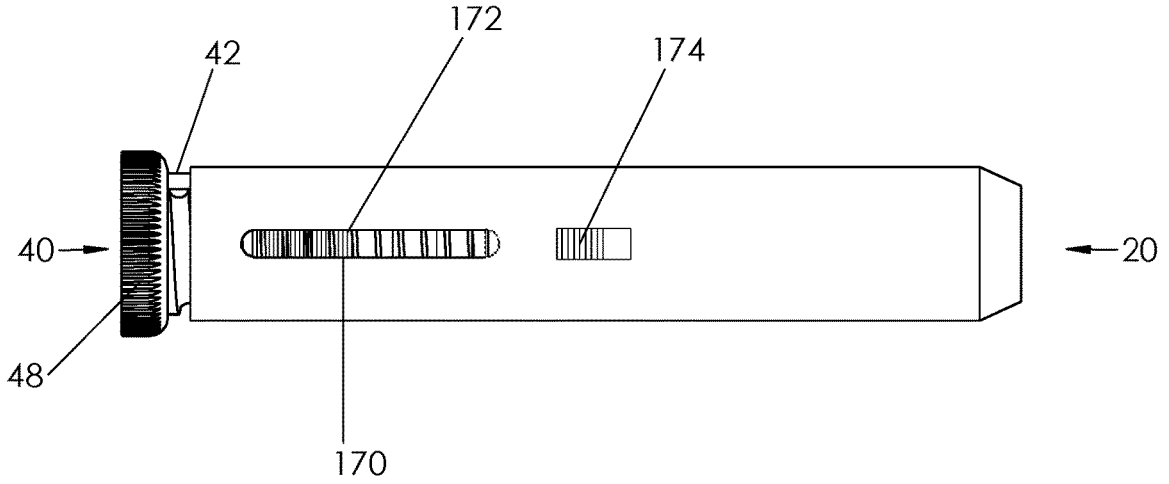

In alternative preferred embodiments, at least one of ruled graphical measures and color coded indicators of relative position may be implemented via at least one lockable sliding screen mechanism 172, shown in FIG. 9B, overlaying the transparent window of the preset gauge viewing panel 170. The at least one lockable sliding screen 172 may, when locked in a desired position atop the window, allow precise determination of the relative position of the slip differential bolt 42 and the spring and/or alternative media 12.

In embodiments that incorporate at least one sliding screen 172, to (re-)program the presets the skier may slide the at least one sliding screen 172 into a desired position and lock it in place with at least one suitable locking mechanism 174, including but not limited to a latch or button operated lock. The at least one sliding screen mechanism 172 may be configured to give a tactile clicking sensation as they slide from one setting to the next to provide an objective sense of the position of the at least one sliding screen 172.

For embodiments with two or more lockable sliding screens 172 overlaying the transparent window, the sliding screens 172 may overlay each other or may be implemented side by side. The sliding screens 172 may be locked in place by individual respective corresponding locking mechanisms 174 or by one single locking mechanism 174 corresponding to all of the sliding screens 172.

Figure 10A:
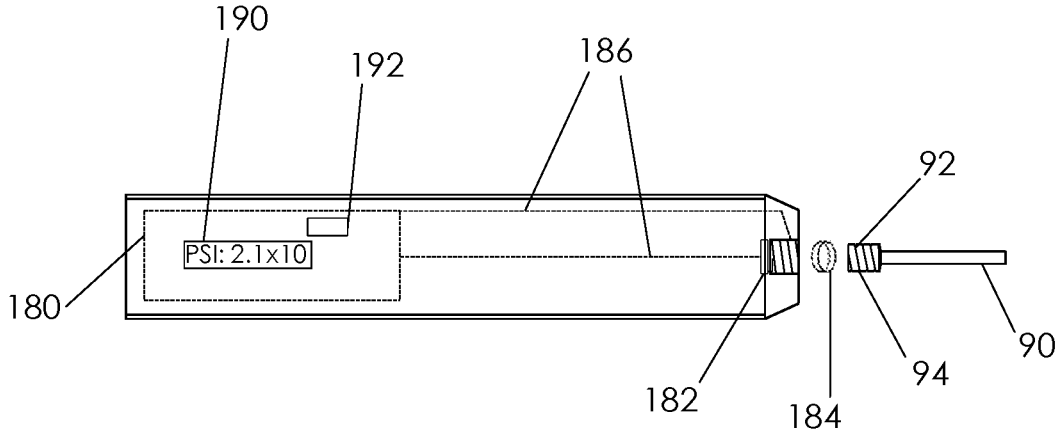
FIG. 10A illustrates the slip differential cassette cylinder including a microcomputer, shown by a dashed outline behind the preset gauge viewing panel, a pressure sensor, and a battery power source.
Figure 10B:
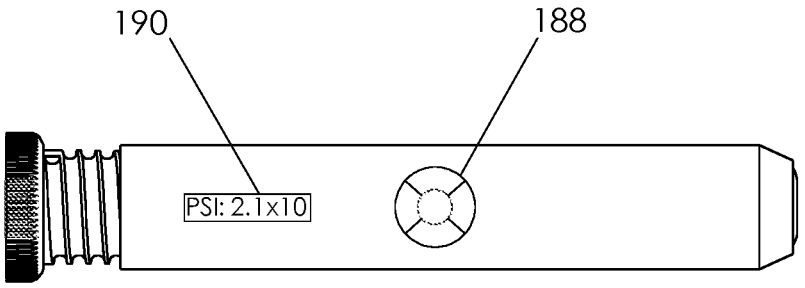
FIG. 10B illustrates the slip differential cassette cylinder including the microcomputer input buttons.

In additional alternative preferred embodiments, as depicted in FIGS. 10A and 10B, the preset gauge viewing panel 170 may further comprise a computer display 190 electrically connected to and in communication with an on-board microcomputer 180, which is in turn electrically connected to and in communication with a power source 184, at least one microcomputer input buttons 188, and at least one of pressure, strain, and stress sensors 182. Electrical connections 186, which may be housed inside the wall of the cassette cylinder 60, between the power source 184, the onboard microcomputer 180, the computer display 190, the at least one microcomputer input buttons 188, and the at least one of pressure, strain, and stress sensors 182, may provide each of these components with power and/or data.

The cassette nut 22, cassette cap 24, slip differential bolt 42, piston head 18, or other cassette components may incorporate the at least one of pressure, strain, or stress sensors 182. The at least one of pressure, strain, and stress sensors 182 are configured to detect forces applied to and by the at least one of a spring and alternative media 12. In certain preferred embodiments the interior facing surface of the cassette nut 22 or cassette cap 24, the surface that engages the cassette piston head 18, incorporates the pressure, strain, or stress sensors 182. The cassette nut 22 or cassette cap 24 may also contain a power source 184, including but not limited to a battery or fuel cell.

Microcomputer input buttons 188 may be configured to provide input to the onboard microcomputer 180 and to select precise stiffness, responsiveness, and range of motion values. Microcomputer input buttons 188 may be provided at locations on the slip differential cassette 10 including but not limited to next to the computer display 190. The computer display 190 may show, for example but not limited to, a graphical representation of the actual relative physical position of the slip differential bolt 42 or the physical position of the slip differential bolt 42 as measured in English, metric, or other units, digital readings of pressure, strain, or stress values, equivalent stiffness values, and/or other slip differential cassette 10 status readings.

In certain preferred embodiments an onboard microcomputer 180 is housed within the wall of the cassette cylinder 60. With the aid of the onboard microcomputer 180, the skier may input presets by adjusting the slip differential cassette to the desired setting and using the input buttons 188 to command the onboard microcomputer 180 to save the setting in a memory 192. Alternatively, the microcomputer 180 may be instructed to save arbitrary values as preset selections in the memory 192.

In embodiments implementing presets through an onboard microcomputer 180, any number of presets may be preprogrammed and stored in the memory 192 of the microcomputer 180. The memory 192 may comprise any computer readable medium that does not comprise solely signals or energy and for the purposes of this description the term computer readable medium specifically excludes signals and energy.

The skier may use the input buttons 188 to select any desired preset stored in the memory 192 or to enter an arbitrary desired preset. The skier may then manually adjust the position of the slip differential bolt 42 until the onboard microcomputer 180 alerts the skier, visually—via the computer display 190, audibly, tactilely (vibration mode), or otherwise, that the desired preset configuration has been achieved. In alternative preferred embodiments where the slip differential cassette 10 informs the skier via a vibration mode or audible tone that manual adjustment of the slip differential bolt 42 has achieved the precise relative positions of the slip differential bolt 42 and the spring and/or alternative media 12 corresponding to the desired preset, the tactile vibration or audible tone alert may be implemented via piezoelectric transducers included in the cylinder 60, on the onboard microcomputer 180, or in the computer display 190 or input buttons 188.

The claimed invention may be expressed in alternative arrangements while still maintaining the spirit of its original purpose and fundamental features. The described embodiments explain but do not limit the invention to the selected exemplary embodiments. Details concerning the invention are covered in the appended claims rather than the previous description. Additional information in the claims concerning the present invention are to be realized to the extent of their own capacity.

Various modifications and variations of the described cassette and its components will be apparent to those skilled in the art without departing from the scope and spirit of the invention. Although the disclosure has been described in connection with specific preferred embodiments, it should be understood that the invention as claimed should not be unduly limited to such specific embodiments. Indeed, those skilled in the art will recognize, or be able to ascertain using no more than routine experimentation, many equivalents to the specific embodiments of the invention described herein. Such equivalents are intended to be encompassed by the following claims.

In the preceding description, various aspects of claimed subject matter may have been described. For purposes of explanation, specific numbers, systems, or configurations may have been set forth to provide a thorough understanding of claimed subject matter. However, it should be apparent to one skilled in the art having the benefit of this disclosure that claimed subject matter may be practiced without those specific details. In other instances, features that would be understood by one of ordinary skill in the art were omitted or simplified so as not to obscure claimed subject matter.

While certain features have been illustrated or described herein, many modifications, substitutions, or equivalents may not occur to those skilled in the art. It is, therefore, to be understood that the appended claims are intended to cover all such modifications or changes as fall within the true spirit of the claimed subject matter.

What is claimed is:

1. A free-heel ski binding, comprising:

a doubly open-ended cylinder, having a first end and a second end;

a piston, having a head and a shaft;

at least one spring device received within the cylinder and configured to be compressed by the piston head;

a cylinder nut or cap configured to attach to a portion of the first end of the doubly open-ended cylinder, to adjust a compression applied to the at least one spring device, enabling a modifiable binding stiffness and responsiveness, and to modify a binding range of motion and an amount of binding free-heel extension by adjusting a distance that the piston head is capable of traveling towards the second end;

wherein the portion of the first end of the doubly open-ended cylinder comprises either female threading along a portion of the interior of the cylinder configured to attach to a portion of male threading on a cassette nut or male threading along a portion of the exterior of the cylinder configured to attach to a portion of female threading on a cassette cap.

2. A free-heel ski binding, comprising:

a doubly open-ended cylinder;

a piston, having a head portion and a shaft portion;

at least one spring device received within the cylinder and configured to be compressed by the piston head;

a cylinder nut or cap configured to attach to a portion of an end of the doubly open-ended cylinder, to adjust a compression applied to the at least one spring device, enabling a modifiable binding stiffness and responsiveness, and to modify a binding range of motion and an amount of binding free-heel extension by adjusting a distance that the piston head is capable of traveling;

wherein the portion of the end of the doubly open-ended cylinder comprises either female threading along a portion of the interior of the cylinder configured to attach to a portion of male threading on a cassette nut or male threading along a portion of the exterior of the cylinder configured to attach to a portion of female threading on a cassette cap.

3. The free-heel ski binding of claim 2, wherein the cylinder is configured to connect to a binding heel-connector via a first connecting portion and to one of a binding heel-piece, ski, ski plate, and binding toe-piece via a second connecting portion, wherein the first and second connecting portions may be provided by one or more of a latch, tubing, solid-core wire, stranded wire, braided wire, cable, cord, and chain.

4. The free-heel ski binding of claim 2, wherein the exterior surface of the cylinder cap is equipped to receive a tool interface.

5. The free-heel ski binding of claim 4, wherein the exterior surface of the cylinder cap is equipped to receive a tool, including one or more of a hex tool, a wrench tool, a Philips head screwdriver, and a flat head screwdriver.

6. The free-heel ski binding of claim 2, further including a preset gauge viewing panel, wherein the preset gauge viewing panel implements at least one of a window, ruled graphical measures, and color coded indicators of relative position.

7. The free-heel ski binding of claim 6, wherein the preset gauge viewing panel comprises a window on the side of the cylinder configured to show the interior of the cylinder and respective positions of the at least one spring device, indicating a corresponding effective stiffness, a specific binding range of motion and an amount of free-heel extension enabled by the free-heel ski binding.

8. The free-heel ski binding of claim 2, wherein the at least one spring device comprises a nested spring, composed of two or more springs, one set inside of another.

9. The free-heel ski binding of claim 8, wherein the springs have one or more of different parameters and different spring constants, configured to produce a graduated or graded, staged stiffness and response action of the binding mechanism.

10. The free-heel ski binding of claim 2, wherein the at least one spring device comprises a variable pitch spring, composed of a spring having one or more of a variable average distance between the active coils, a variable average coil diameter and a variable average spring gauge or thickness.

11. A free-heel ski binding, comprising:

a doubly open-ended cassette cylinder;

a piston, having a head and a shaft;

at least one spring device received within the cassette cylinder and configured to be compressed by the piston head;

a cassette cylinder nut or cap configured to attach to a portion of an end of the doubly open-ended cassette cylinder, to adjust a compression applied to the at least one spring device, to enable an adaptable binding stiffness and responsiveness, and to modify a range of motion of the binding, an amount of binding free-heel extension by adjusting a starting length of the spring, a distance that the piston head is capable of traveling during spring compression, and a total amount of compression that the piston head can apply to the at least one spring device;

wherein the portion of the end of the doubly open-ended cylinder comprises either female threading along a portion of the interior of the cylinder configured to attach to a portion of male threading on a cassette nut or male threading along a portion of the exterior of the cylinder configured to attach to a portion of female threading on a cassette cap.

12. The free-heel ski binding of claim 11, wherein the cylinder is configured to connect to a binding heel-connector via a first connecting portion and to one of a heel-piece, toe-piece, ski plate, and ski via a second connecting portion, wherein the first and second connecting portions are provided by one or more of a latch, tubing, solid-core wire, stranded wire, braided wire, cable, cord, and chain.

13. The free-heel ski binding of claim 12, wherein the exterior surface of the cylinder cap is equipped to receive a tool interface.

14. The free-heel ski binding of claim 13, wherein the exterior surface of the cylinder cap is equipped to receive a tool, including one or more of a hex tool, a wrench tool, a Philips head screwdriver, and a flat head screwdriver.

15. The free-heel ski binding of claim 12, further including a preset gauge viewing panel, wherein the preset gauge viewing panel implements at least one of a window, ruled graphical measures, and color coded indicators of relative position.

16. The free-heel ski binding of claim 15, wherein the preset gauge viewing panel comprises a window on the side of the cassette cylinder configured to show the interior of the cylinder and respective positions of the at least one spring device, indicating a corresponding effective stiffness, a specific binding range of motion and an amount of free-heel extension enabled by the free-heel ski binding.

17. The free-heel ski binding of claim 12, wherein the at least one spring device comprises a nested spring, composed of two or more springs, one set inside of another.

18. The free-heel ski binding of claim 17, wherein the springs have one or more of different parameters and different spring constants, configured to produce a graduated or graded, staged stiffness and response action of the binding mechanism.

19. The free-heel ski binding of claim 11, wherein the at least one spring device comprises a variable pitch spring, composed of a spring having one or more of a variable average distance between the active coils, a variable average coil diameter and a variable average coil gauge or thickness.

* * * * *